US005922276A

United States Patent [19]

Cascone

[11] Patent Number: 5,922,276

[45] Date of Patent: Jul. 13, 1999

[54] GOLD ALLOY FOR PORCELAIN/METAL DENTAL RESTORATIONS

[75] Inventor: Paul J. Cascone, Del Mar, Calif.

[73] Assignee: The Argen Corporation, San Diego, Calif.

[21] Appl. No.: 09/024,089

[22] Filed: Feb. 17, 1998

[51] Int. Cl.[6] ..... C22C 5/02

[52] U.S. Cl. ..... 420/507; 420/508; 420/509; 420/510; 148/430; 433/207

[58] Field of Search ..... 420/507, 508, 420/509, 510; 148/430; 433/207; C22C 5/02

[56] References Cited

U.S. PATENT DOCUMENTS

| | | | |
|---|---|---|---|
| 3,052,982 | 9/1962 | Weinstein et al. | 32/8 |
| 4,123,262 | 10/1978 | Cascone | 75/165 |
| 4,387,072 | 6/1983 | Schaeffer | 420/463 |
| 5,076,789 | 12/1991 | Tanaka | 420/508 |
| 5,431,875 | 7/1995 | Cameron et al. | 420/463 |

FOREIGN PATENT DOCUMENTS

| | | | |
|---|---|---|---|
| 4419408 | 7/1995 | Germany | C22C 5/02 |
| 9728779 | 8/1997 | WIPO | A61K 6/04 |

*Primary Examiner*—Prince Willis
*Assistant Examiner*—Andrew L. Oltmans
*Attorney, Agent, or Firm*—Sprung Kramer Schaefer & Briscoe

[57] ABSTRACT

A dental alloy is provided for use in porcelain-fused-to-metal dental restorations, which has an excellent oxide color and which can be cast and recast without deleterious effect, which comprises at least 99.5 wt. % gold, 0.1–0.25 wt. % zinc, 0.1–0.25 wt. % indium and 0–0.3 wt. % total of Rt, Pd, Rh, Ir, Re or combinations thereof.

2 Claims, No Drawings

GOLD ALLOY FOR PORCELAIN/METAL DENTAL RESTORATIONS

FIELD OF THE INVENTION

This invention pertains to a novel gold alloy useful for the preparation of porcelain-fused-to-metal dental restorations.

BACKGROUND OF THE INVENTION

Gold alloys have long been used for the preparation of dental restorations, such as dentures and dental prosthetic parts.

For aesthetic reasons, porcelain-fused-to-metal construction has become increasingly popular.

The invention of the porcelain-fused-to-metal processing technique (Weinstein, et al. U.S. Pat. No. 3,052,982) was readily accepted in the marketplace and became the procedure of choice because both function and aesthetics were addressed by it. This technique involves casting a thin metal alloy substructure and baking successive layers of porcelain onto the alloy, until the proper bulk and form is achieved. The porcelain provides the life-like appearance of natural teeth, while the metal alloy substructure provides the necessary strength and durability for repeated mastication.

The requirements for alloys used in porcelain-fused-to-metal construction, in accordance with the prior art, were thought to be:

1. High strength. For example, U.S. Pat. No. 3,981,723 teaches an alloy which has strength values approaching ADA Spec. No. 5, or Type IV dental casting gold alloys (Type IV is the highest strength requirements).

2. Thermal expansion coefficient "matched" to the porcelain. For example, U.S. Pat. No. 5,423,680 discusses the range of ceramic thermal expansion coefficients existing in the marketplace and teaches how to increase the thermal expansion coefficients of alloys to high levels.

3. Bondable to porcelain. The necessity to have an oxide present on the metal surface in order for porcelain to adhere was recognized in the 1960's. U.S. Pat. No. 4,205,982 discusses the role of base metals in porcelain bonding.

4. A solidus temperature higher than the firing temperature of the porcelain. The solidus temperature of an alloy is the point at which the alloy begins to melt. If this temperature is lower than the porcelain firing temperature, then the alloy will melt rendering it useless. U.S. Pat. No. 4,205,982 also discusses this problem.

Over the years, however, the market place has seen various developments which placed additional demands upon the alloys. The driving force for such developments has always been to improve the aesthetics of the restorations.

Thus, the demand for more economical alloys in the 1970's resulted in more silver being used in the alloys; but silver caused a discoloration in the porcelain. U.S. Pat. No. 4,123,262 and U.S. Pat. No. 4,387,072 eliminated the need for silver in the alloy composition.

Alternate materials and new porcelains were developed to be more life-like, and modified alloys, such as those taught by U.S. Pat. No. 5,462,437 were needed to accommodate the new porcelain.

The base metals used in the alloys sometimes produced a dark oxide, however, and it can be difficult to mask such oxides with the porcelain firings. The final restoration can in such circumstances therefore be left with an unsightly dark line at the porcelain-metal junction. U.S. Pat. No. 5,431,875 discloses a particular mix of base elements which is said to produce a light colored oxide on a palladium alloy.

Recent concerns in the market place therefore relate to the biocompatibility of the alloy as well as improved alloy-porcelain aesthetics.

German Patent DE 44 19 408 C 1 teaches of an alloy containing 95–98% gold, 1–4% titanium and 0.05–1.5% of the further elements Re, Rh, Ru, Ir and/or Ta. This alloy is said to be very biocompatible and to also have excellent aesthetics, due to its high gold content. Although the titanium content adds a degree of hardness to the alloy, it causes difficulties in reusing (i.e., recycling) the alloy. The titanium present in the alloy oxidizes so rapidly that most of it is depleted after a single casting. This severely limits the amount of alloy that can be recycled, making the restoration more expensive to produce. Normally, up to 50% of the metal in a restoration is recycled alloy.

It is therefore the object of this invention to provide a novel alloy that is at the same time economical, biocompatible and has good aesthetics.

SUMMARY OF THE INVENTION

Surprisingly and unexpectedly, a novel alloy has been found that enables the preparation of restoration having excellent oxide color, while avoiding the difficulties encountered in the prior art.

In accordance with the invention it has now been found that the requirements of strength and high thermal expansion coefficients discussed above are not necessary if single porcelain-to-metal crowns are fabricated from the alloys of this invention. The strength requirement is not needed due to both the intrinsic design of a single crown (somewhat analogous to an eggshell) and the fact that, since there are no connectors to adjacent units, as there would be in the case of a bridge, less alloy strength is needed. The thermal expansion coefficient requirement is reduced due to both the design of the crowns and the high gold content of the novel alloy. The design allows for the rapid transfer of heat out of the alloy (the entire inside surface is open to the atmosphere). This minimizes any stress build up in the porcelain due to differences in thermal expansion between the alloy and porcelain. The fact that gold transfers heat over 1000 times faster than the porcelain further enhances this effect.

The novel alloy can be reused (i.e., recycled) without difficulty, and produces a light-colored oxide which enables porcelain-fused on to the alloy to display a pleasing life-like color.

The novel alloy comprises at least 98% by weight gold, 0.1–0.5 wt. % zinc, 0.1–0.5 wt. % indium and 0 to 2 wt. % total of Pt, Pd, Rh, Ir, and/or Re. In the preferred embodiments, the alloy consists essentially of 0.1–0.25 wt. % zinc, 0.1–0.25 wt. % indium with the balance to 100 wt. % being gold.

DETAILED DESCRIPTION

The alloys of this invention are prepared by conventional means. Typical elemental purities of the materials used are:

| | |
|---|---|
| Gold | 99.95% |
| Indium | 99.99% |
| Zinc | 99.5% |
| Platinum | 99.5% |

The individual elements are first weighed to the proper proportions, and then physically placed into a crucible and heated, e.g., via a low frequency induction furnace. A blanketing gas of carbon monoxide may be used to minimize oxidation. The alloy is heated until molten, and then poured into a suitable mold. The material is then rolled down to a suitable thickness so small ingots can be cut.

The alloy casting, preformed by a dental laboratory, is also done by conventional means.

EXAMPLES

Porcelain-fused-to-metal crowns were prepared by conventional means, using the alloys listed below, and evaluated for color, solidus temperature and porcelain conditions, as indicated below.

Example 1

Inventive Alloy

| | | | |
|---|---|---|---|
| Au | 99.8% wt. | Oxide color | Light gold |
| In | .1% wt. | Solidus | 1032C |
| Zn | .1% wt. | Porcelain | No problems |

Example 2

Inventive Alloy

| | | | |
|---|---|---|---|
| Au | 99.0% wt. | Oxide color | Light gold |
| Pt | 0.7% wt. | Solidus | 1042C |
| Zn | 0.3% wt. | Porcelain | No problems |

Example 3

Comparative Alloy

| | | | |
|---|---|---|---|
| Au | 99.0% wt. | Oxide color | Light orange |
| Mn | 1.0% wt. | Solidus | 1040C |
| | | Porcelain | Dark line at margins |

Example 4

Comparative Alloy

| | | | |
|---|---|---|---|
| Au | 99.6% wt. | Oxide color | Medium brownish gold |
| Fe | .3% wt. | Solidus | 1046C |
| Zn | 1% wt. | Porcelain | No problems |

Example 5

Comparison Alloy

| | | | |
|---|---|---|---|
| Au | 99.0% wt. | Oxide color | Light grey |
| Cu | .9% wt. | Solidus | 1023C |
| Zn | .1% wt. | Porcelain | No problems |

As can be seen from the examples, the inventive alloys produced oxides having a desirable light gold color, whereas the comparison alloys produced undesirable colors such as light grey, light orange and brownish gold. In addition, the crown made from the Mn containing alloy resulted in a dark line at the porcelain margins.

It can be seen that the addition of elements such as copper, manganese and iron resulted in a dark or colored oxide. This oxide color interferes with the porcelain shading, and is therefore undesirable.

Mixtures of indium and zinc are found to produce a light gold oxide, which is desirable. Additions of less than two-percent platinum, palladium, rhodium, iridium and/or rhenium do not interfere with the oxide color. In the prior art, iridium and rhenium are added to alloys to grain refine the alloy. This procedure is not required in the present invention, but can be used if desired.

The alloys according to the invention can be cast and recast (i.e., recycled) without deleterious effects, and this is a particular advantage.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. An alloy comprising at least 99.5% by weight gold, 0.1–0.25 wt. % zinc, 0.1–0.25 wt. % indium and 0–0.3 wt. % total of Pt, Pd, Rh, Ir, Re or combinations thereof.

2. The alloy of claim 1, consisting essentially of 99.7 wt. % gold, 0.2 wt. % indium and 0.1 wt. % zinc.

* * * * *